US012331976B2

(12) United States Patent
Lee et al.

(10) Patent No.: US 12,331,976 B2
(45) Date of Patent: Jun. 17, 2025

(54) ICE MAKER

(71) Applicant: MUDATECH KOREA CO., LTD., Seoul (KR)

(72) Inventors: Myung Ryul Lee, Yongin-si (KR); Omid Nematollahi, Changwon-si (KR); Mehdi Rasti, Gunpo-si (KR); Seyed Mohammad Reza Mostafaei, Changwon-si (KR); Amir Hossein Kholghi, Changwon-si (KR); Fatemeh Ghadiri Modarres, Changwon-si (KR); GholamHosein Kasaei, Izmir (TR)

(73) Assignee: MUDATECH KOREA CO., LTD., Seoul (KR)

( * ) Notice: Subject to any disclaimer, the term of this patent is extended or adjusted under 35 U.S.C. 154(b) by 95 days.

(21) Appl. No.: 17/994,897

(22) Filed: Nov. 28, 2022

(65) Prior Publication Data

US 2024/0003607 A1 Jan. 4, 2024

(30) Foreign Application Priority Data

Jun. 30, 2022 (KR) ..... 10-2022-0080740

(51) Int. Cl.
*F25C 1/10* (2006.01)
*F25C 1/24* (2018.01)

(52) U.S. Cl.
CPC ..... *F25C 1/10* (2013.01); *F25C 1/24* (2013.01); *F25C 2300/00* (2013.01); *F25C 2400/10* (2013.01); *F25C 2700/02* (2013.01)

(58) Field of Classification Search
CPC ..... F25C 1/10; F25C 1/22; F25C 1/24; F25C 1/25; F25C 5/185; F25C 5/187; F25C 5/22; F25C 2300/00; F25C 2400/10; F25C 2400/14; F25C 2700/02; F25C 2700/12; F25C 2305/022; F25C 2305/0221
See application file for complete search history.

(56) References Cited

U.S. PATENT DOCUMENTS

2019/0011167 A1* 1/2019 Larson ..... F25C 5/08
2019/0041112 A1* 2/2019 Chatelle ..... F25C 5/22

FOREIGN PATENT DOCUMENTS

KR 20220049942 A * 4/2022
WO WO-2019012715 A1 * 1/2019 ..... F25C 1/10

OTHER PUBLICATIONS

English translation of Kono et al. (WO 2019012715 A1). (Year: 2019).*
English translation of Donghoon et al. (KR 20220049942 A) (Year: 2022).*

* cited by examiner

*Primary Examiner* — Miguel A Diaz
(74) *Attorney, Agent, or Firm* — NKL Law; Jae Youn Kim

(57) ABSTRACT

Proposed is an ice maker disposed in a refrigerator to provide ice to an ice bucket. The ice maker may include a tray configured to be filled with water and positioned in the ice maker to freeze the water to make ice, the tray includes a high thermal conductive composite material configured to emit heat in response to an electric current supplied thereto; a tray cap connected to top of the tray to reduce an area of top of the tray so that the water filled in the tray is prevented from overflowing because of the inertia generated by the movement of the tray; a frame assembly connected to the tray; electrodes connected to both sides of the tray, respectively; and a motor connected to the tray to rotate the tray so that the ice is separated from the tray by gravity.

12 Claims, 8 Drawing Sheets

ICE MAKER

FIELD OF INVENTION

The present invention relates to an ice maker.

DESCRIPTION OF RELATED ART

Generally, a refrigerator is a home appliance used for keeping things cold or frozen by using a refrigeration cycle. The refrigerator includes a body in which a storage room such as a freezing room and a refrigerating room is disposed and a door located on the body to open and close the storage room.

Further, a space in which ice is made and stored is provided in the storage room or door. Accordingly, an ice maker has a tray, a water feeding device for supplying water to the tray, an ice bucket, a chute, a dispenser, etc.

Generally, the ice separation from the ice tray of household refrigerators is performed by heating the tray or by mechanically twisting the tray to separate the ice from the contact surfaces. After the ice is separated from the contact surfaces, the ice falls down into the ice bucket by gravity.

In the case of heating type ice makers, the tray is made of high thermal conductivity materials such as aluminum. After the tray is heated, the ice is separated from the tray using an ejector. The heating type ice maker is used in refrigerators that are supposed to produce a large amount of ice. However, an amount of power consumed because of the heating may be large. In addition, only pieces of half moon-shaped ice may be made because an ejector is used. Moreover, compared to twisty type ice makers, heating type ice makers are thicker because they need more space to discharge the ice from the tray into the ice bucket.

In the case of twisting ice makers, ice making is performed in a relatively small space. In this case, the tray is generally made of a flexible plastic material, which causes low thermal conductivity. Accordingly, this method is used for general household refrigerators that are supposed to produce a relatively small amount of ice.

Further, the pieces of ice made in the plastic tray are generally cube-shaped because of their separation problem from the tray. The tray may be made of silicone or rubber to make pieces of ice with various shapes, but in this case, it may cause problems in separating the pieces of ice through its rotation.

SUMMARY OF THE INVENTION

Accordingly, the present invention has been made to solve the above-mentioned problems, and it is an object of the present invention to provide an ice maker that is capable of being disposed in a narrow space to make pieces of ice with various shapes, while producing a relatively large amount of ice because of high-speed ice making.

To accomplish the above-mentioned objects, according to one or more embodiments of the present invention, an ice maker may be disposed in a refrigerator to provide ice to an ice bucket. The ice maker may include a tray filled with water and positioned in the ice maker to freeze the water to make the ice, the tray including a high thermal conductive composite material configured to emit heat in response to an electric current is supplied thereto; a frame assembly connected to the tray; electrodes connected to two sides of the tray; and a motor connected to the tray to rotate the tray so that the ice is separated from the tray by gravity.

The tray may include a plurality of ice making parts arranged in a zigzag manner (formation), moving parts each connecting the neighboring ice making parts to each other to move the water there along, and tray walls extending outward from the ice making parts to prevent the water filled in the tray from overflowing even while a refrigerator door is opening or closing. However, the formation of the plurality of ice making parts is not limited to the zigzag formation, and it can be arranged in any manners appreciated by one of ordinary skill in the art.

Each moving part may be positioned to form a diagonal line between the neighboring zigzag ice making parts.

The tray may include curved surfaces concavely formed from the tray walls to the ice making parts.

The tray walls may have heights higher by 1.5 to 3 times than heights of the ice making parts.

The ice making parts may have different sectional shapes from one another.

The electrodes may be located on portions where the ice is separated from the ice making parts on the outside of the tray.

The ice maker may further include a tray cap connected to top of the tray to reduce an area of top of the tray so that the water filled in the tray is prevented from overflowing because of the inertia generated by the movement of the tray.

The tray cap may include a guard part slantly formed and deformed in shape by the transfer of the ice and tray connectors protruding from the guard part and thus connected to the tray.

The high thermal conductive composite material may be made of any one polymer selected from a carbon fiber, a carbon nanotube, a graphene, and a metal-containing polymer.

The frame assembly may include supports having fitting grooves formed thereon to connect the tray thereto, a frame extending in a longitudinal direction of the tray to connect the supports thereto, and a guide part connected to top of the frame and having an inclined injection portion formed therein to move the water to the tray.

The frame may have a plurality of ribs located toward the tray.

The motor may rotate the tray to an angle in the range between 100 and 180°.

The motor may detect full ice in the ice bucket according to the rotating angle of the tray.

According to one or more embodiments of the present invention, the ice maker may be configured to be disposed in a narrow space to make pieces of ice with various shapes, while it produces a relatively large amount of ice because of high-speed ice making.

DETAILED DESCRIPTION

Figure 1:
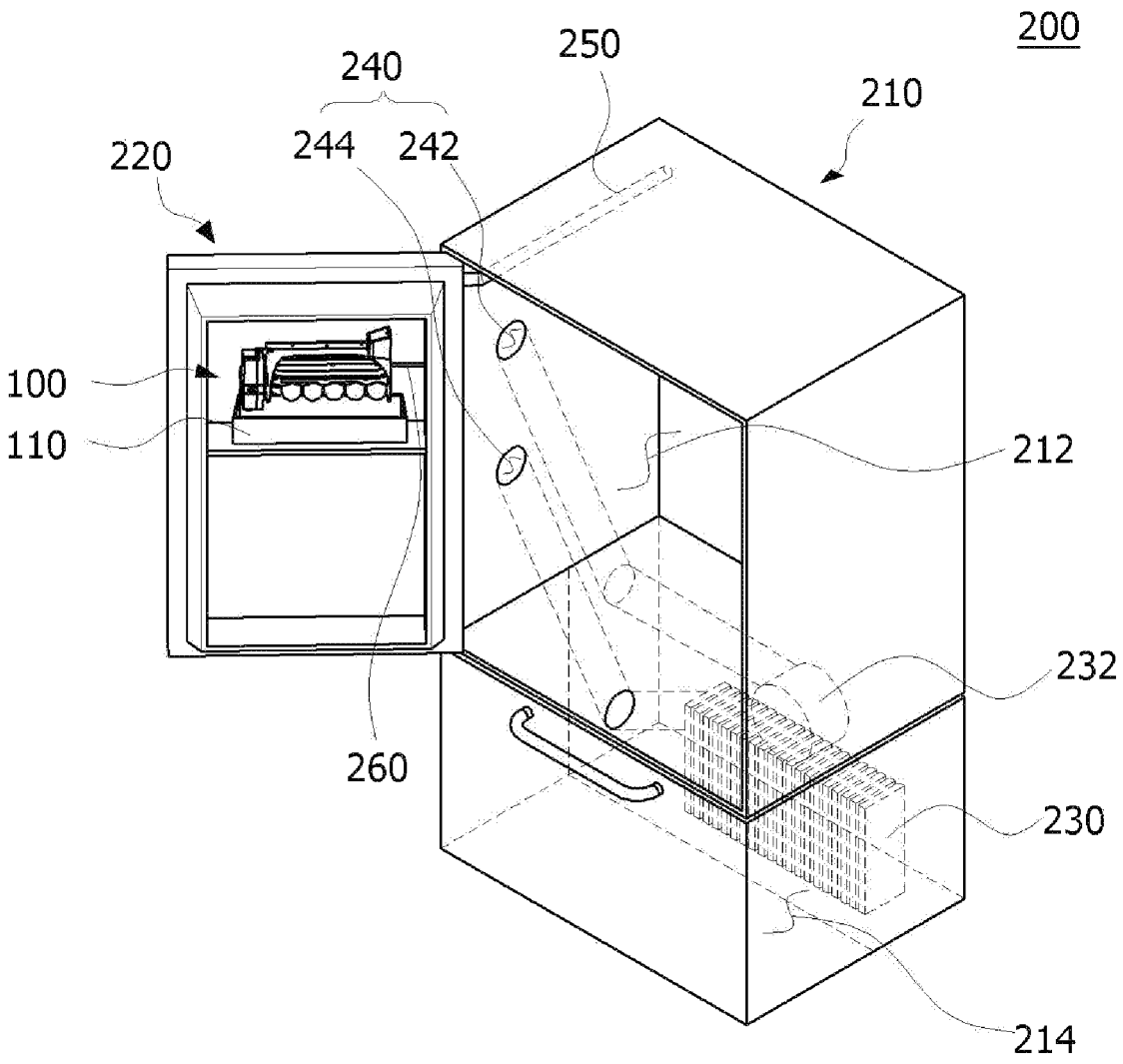
FIG. 1 is a perspective view showing a refrigerator whose door is connected to an ice maker according to an embodiment of the present invention.

Hereinafter, embodiments of the present invention will be described in detail with reference to the attached drawings. It is understood that the disclosed embodiments are merely exemplary embodiments of the invention, which can be embodied in various forms. If it is determined that the detailed explanation on the well-known technology related to the present invention makes the scope of the present invention not clear, the explanation will be avoided for the brevity of the description. In the description and drawings, the corresponding parts in the embodiments of the present invention are indicated by corresponding reference numerals.

In the description, the term 'coupled' or 'connected', as used herein, is defined as connected, although not necessarily directly, and not necessarily mechanically. To the contrarily, the term 'directly coupled' or 'directly connected', as used herein, is defined as connected without having any component disposed therebetween. In the description, when it is said that one portion is described as "includes" any component, one element further may include other components unless no specific description is suggested.

Hereinafter, the present invention will be described in detail with reference to the attached drawings.

FIG. 1 is a perspective view showing a refrigerator whose door is connected to an ice maker according to an embodiment of the present invention.

As shown in FIG. 1, a refrigerating room 212 is disposed on the upper portion of a body 210, and a freezing room 214 on the lower portion of the body 210. However, their positions are not limited necessarily thereto. For example, the freezing room 214 may be disposed on the upper portion of the body 210, and otherwise, one or more embodiments of the present invention may be applied even to a side-by-side type refrigerator in which the refrigerating room 212 and the freezing room 214 are disposed side by side. An exemplary embodiment of the present invention will be described with reference to FIG. 1.

Referring to FIG. 1, a refrigerator 200 includes the body 210 and a door 220. The body 210 includes the refrigerating room 212 and the freezing room 214. Further, an evaporator 230 is located on the rear surface of the freezing room 214. The cold air produced from the evaporator 230 is supplied and/or collected to and from the freezing room 214 and the refrigerating room 212 through cold air ducts 240. For example, the cold air ducts 240 supply the cold air generated from the evaporator 230 disposed on the rear side of the freezing room 214 to the refrigerating room 212 and/or the freezing room 214. Through the operation of a cold air fan 232 disposed around the evaporator 230, a substantially large amount of cold air is introduced into the freezing room 214, and a given amount of cold air moves to an ice maker 100 through the cold air ducts 240.

Each cold air duct 240 includes a cold air inlet 242 and a cold air outlet 244. The cold air inlet 242 and the cold air outlet 244 are formed on the side surface of the body 210 with respect to the ice maker 100. When the door 220 is closed, the ice maker 100 is connected to the cold air inlet 242 and the cold air outlet 244. Accordingly, the cold air is introduced or emitted into or from the ice maker 100 only when the door 220 is closed.

The door 220 is rotatably connected to the body 210 to open and close the refrigerating room 212 and the freezing room 214. The door 220 includes a refrigerating room door 220 and a freezing room door 220.

The ice maker 100 is disposed on the refrigerating room door 220. For example, an ice bucket 110 is additionally disposed on the refrigerating room door 220 under the ice maker 100. The ice separated from the ice maker 100 is stored in the ice bucket 110. Accordingly, a user opens the refrigerating room door 220 to pick up the ice from the ice bucket 110. For another example, the ice separated from the ice maker 100 is supplied directly to the user through an ice drawing port (not shown) located on the front surface of the refrigerating room door 220.

A water supply hose 250 is located inside the body 210 and connected to the ice maker 100. Through the water supply hose 250, water needed to make ice is supplied automatically to the ice maker 100.

Figure 2:
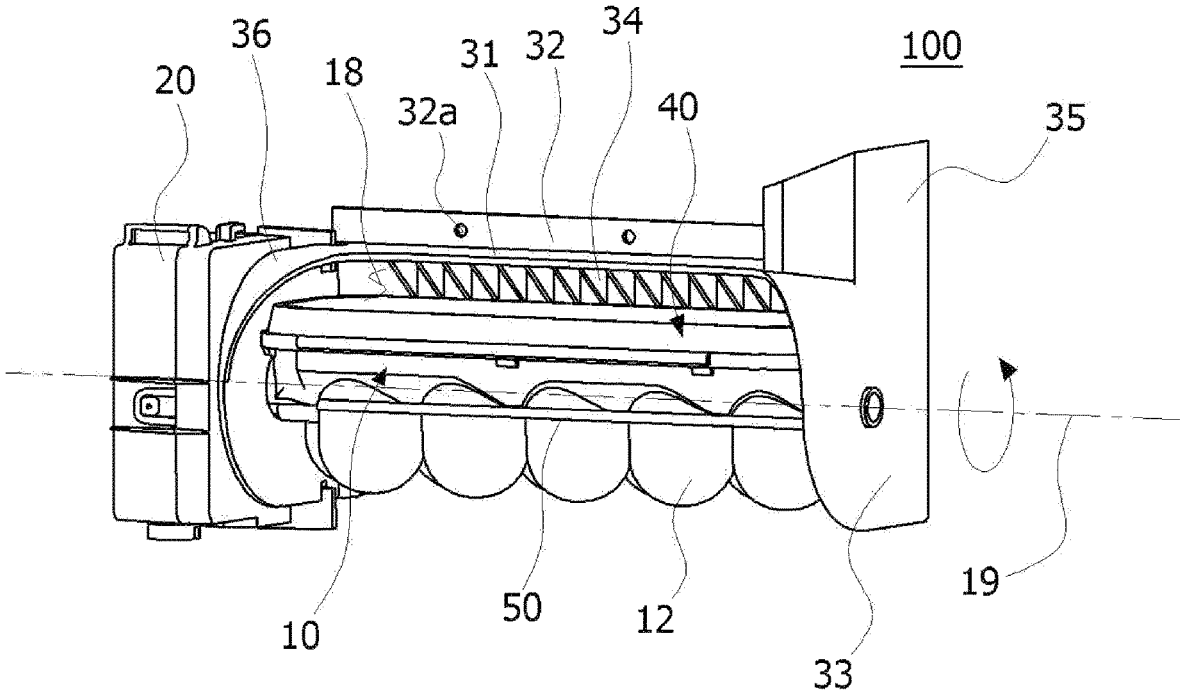
FIG. 2 is a perspective view showing the ice maker according to an embodiment of the present invention.
Figure 3:
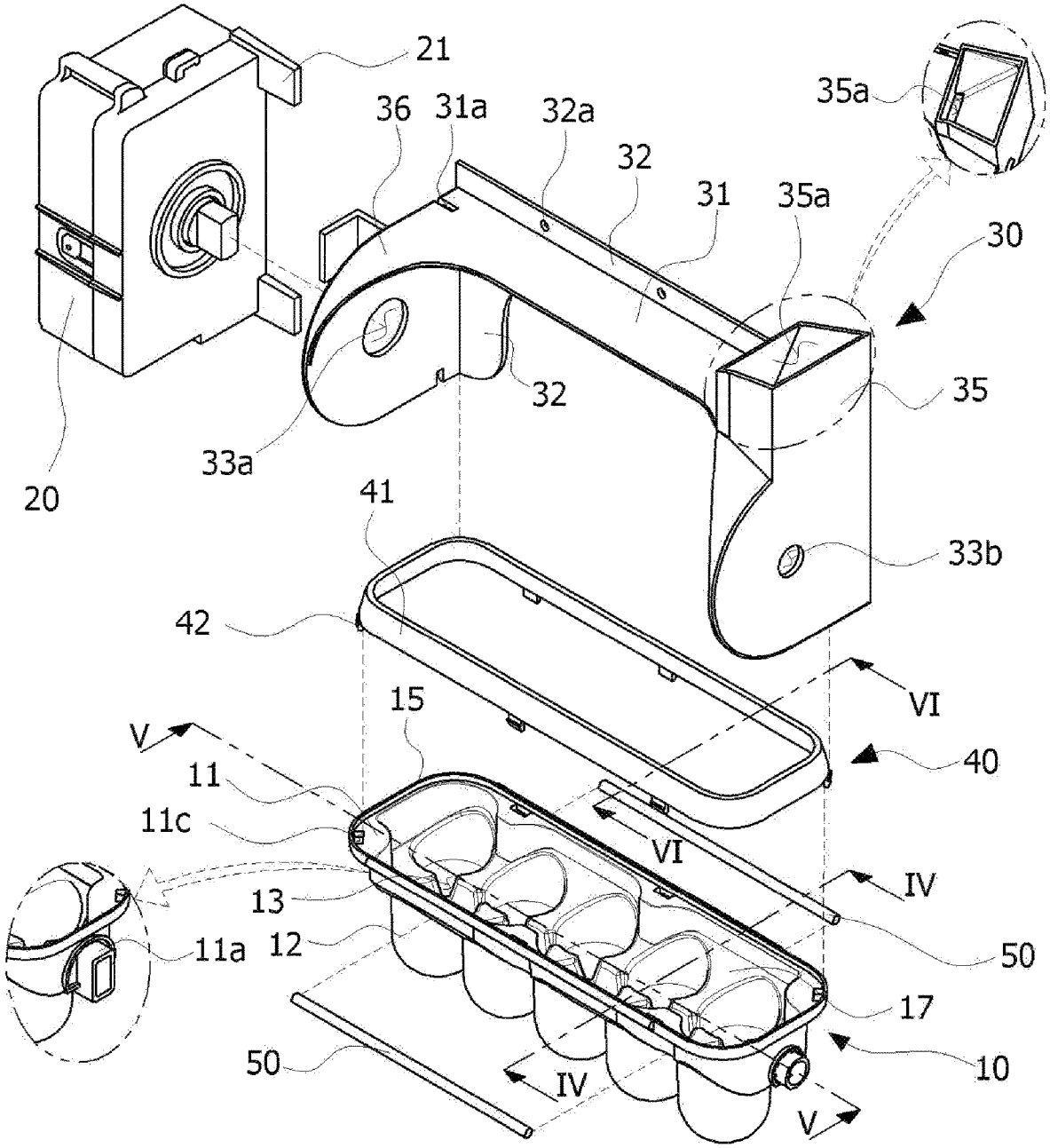
FIG. 3 is an exploded perspective view showing the ice maker of FIG. 2.

FIG. 2 is a perspective view showing the ice maker according to an embodiment of the present invention, and FIG. 3 is an exploded perspective view showing the ice maker of FIG. 2.

Referring to FIGS. 2 and 3, the ice maker 100 includes a tray 10 and a frame assembly 30. Water is supplied to tray 10 and the supplied water turns into ice. The tray 10 includes a tray body 11 and ice making parts 12. Ice making parts 12 may be referred to as ice making holders 12. Further, the tray 10 is located inside the frame assembly 30 and rotatably connected to the frame assembly 30. For example, the tray 10 has connectors 11*a* protruding outward from both side surfaces of the tray body 11. The connectors 11*a* are fittedly connected to the frame assembly 30 to allow the tray 10 to be rotatably supported against the frame assembly 30. For another example, the tray 10 has connection grooves formed on both side surfaces of the tray body 11, and connectors formed on both side surfaces of the frame assembly 30 are fitted to the connection grooves of the tray 10.

A rotation space 18 is formed between the frame assembly 30 and the tray 10. For example, a radius of rotation is formed around a rotating axis 19 formed by the connectors 11*a* of the tray 10, and the radius of rotation has a relation with depths of the ice making parts 12, that is, sizes of the ice making parts 12. The rotation space 18 enables the tray 10 to rotate gently through the rotation space 19. Further, this allows checking whether the insides of the frame assembly 30 and the tray 10 become dirty with the naked eye.

The ice making parts 12 protrude downward from the underside of the tray body 11. The number of ice making parts 12 is plural. Water is supplied to the ice making parts (ice making holders) 12 and the water turns into pieces of ice because of the cold air supplied to the ice making parts (ice making holders) 12. The shapes of the pieces of ice are determined on the inner shapes of the ice making parts (ice making holders) 12. The sectional shapes of the insides of the ice making parts (ice making holders) 12 are freely made to produce the pieces of ice having various shapes. For example, the ice making parts (ice making holders) 12 may have sectional shapes of star, square, circle, triangle, character, and the like. Further, different sectional shapes are combinedly provided to produce pieces of ice having various shapes from one tray.

The plurality of ice making parts (ice making holders) 12 are arranged inside the tray 10 in a zigzag manner. For example, if the ice making parts 12 are disposed in two rows, one row ice making parts 12 are arranged, and the other row ice making parts 12 are arranged in a misaligned manner with one row ice making parts 12, so that between the neighboring one row ice making parts 12, the other row ice making parts 12 are positioned. In this case, the tray 10 can be reduced in size, while the size of ice is being still maintained. Further, an area to which the cold air is supplied can be collectedly formed to improve an ice making efficiency.

Moving parts 13 are formed between the neighboring ice making parts 12 to connect them to each other. Through the moving parts 13, that is, the water supplied to the tray 10 is stored in any one ice making part 12 and sequentially moved to other ice making parts 12. As a result, while the flow of water supplied to the tray 10 is being induced, the amount of water stored in the ice making parts 12 is adjusted, and further, the overflow of water, which may occur when the water is freely filled in the tray 10, is prevented. More specifically, the moving parts 13 are obliquely formed between the neighboring ice making parts 12. Through the moving parts 13, the supplied water is filled into the zigzag-arranged ice making parts 12 sequentially, and if a motion or impact occurs on an object connected to the frame assembly 30, for example, if the refrigerating room door 220 is open, further, the moving parts 13 prevent the water from overflowing to the outside of the tray 10.

The tray 10 is made of a high thermal conductive composite material. An electric current is supplied to the high thermal conductive composite material, and through the heat generated from the high thermal conductive composite material, accordingly, the pieces of ice are separated from the inner surfaces of the ice making parts 12, respectively. More specifically, the bigger the ice making parts 12 become, the bigger the pieces of ice become. If the inner depths of the ice making parts 12 are increased, the pieces of ice become long. Accordingly, the ice making parts 12, which are made of the high thermal conductive composite material from which heat is emitted, apply the heat to the surfaces of the pieces of ice, so that the pieces of ice are separated from the ice making parts 12 more easily. The tray 10 rotates, and the pieces of ice separated from the ice making parts 12 fall down freely, thereby making it possible to more easily separate the pieces of ice from the ice making parts 12.

For example, the high thermal conductive composite material is made of any one polymer selected from carbon fiber, a carbon nanotube, a graphene, and a metal-containing polymer or a combination thereof. That is, the tray 10 improves thermal conductivity and emits heat therefrom through electrodes 50. The tray 10 is connected to the electrodes 50 for supplying the electric current to the high thermal conductive composite material. For example, the electrodes 50 are connected to refrigerator power lines 260.

The tray 10 to which the electric current is supplied from the electrodes 50 emits heat. The electrodes 50 are disposed at the left and right sides with respect to the ice making parts 12, while being close to the portions where ice is made. Because the heating is generated between the two electrodes 50, that is, the two electrodes 50 are desirably located, while placing the ice making parts 12 therebetween.

Each electrode 50 includes a covered electrical wire formed of a bundle of wires. As the electrical wire is formed of the bundle of wires with relatively high flexibility, that is, the electrode 50 ensures good durability in spite of frequent rotations of the electrical wire. For example, the tray 10 is located fixedly, and if ice making on the ice maker 100 is finished, the tray 10 rotates. Next, the electric current is supplied to the electrodes 50 to allow heat to be emitted from the high thermal conductive composite material. That is, electric circuit connection is made according to the locations of the tray 10. For example, if the tray 10 rotates to its original position after the ice making of the ice maker 100 has been finished and the ice has been separated from the tray 10, the supply of the electric current stops. The supply of the electric current is controlled according to the changes in position of the tray 10, without having any additional control device, thereby making the ice maker 100 simplified in a configuration.

A tray cap 40 is connected to the tray 10. The tray cap 40 is located between the tray 10 and the frame assembly 30. The tray cap 40 includes a guard part 41 and tray connectors 42. The tray connectors 42 protrude downward from the guard part 41 in a direction toward the tray 10 and are thus fitted to fitting grooves 11*c* formed on the tray body 11 of the tray 10 to allow the tray 10 and the tray cap 40 to be connected to each other.

The guard part 41 is slantly formed toward the inside of the tray 10. The guard part 41 is adapted to induce water in the direction toward the inside of the tray 10 if a motion or impact occurs on an object connected to the frame assembly 30, for example, if the refrigerating room door 220 is open, to cause the water filled in the tray 10 to splash by inertia, and accordingly, the guard part 41 prevents the water from overflowing to the outside of the tray 10.

A motor 20 is located at the outside of the frame assembly 30 and connected to the tray 10. Between the motor 20 and the tray 10 is located the frame assembly 30. That is, the motor 20 serves to transfer power to the tray 10 rotatably connected supportedly to the frame assembly 30 and thus allows the tray 10 to rotate. For example, the motor 20 rotates the tray 10 to an angle of or more. For example, the motor 20 rotates the tray 10 to an angle in the range between 100 and 180°. Through the rotation, the ice made inside the tray 10 freely falls down by gravity, and through the smooth rotation of the tray 10 even in a narrow space, it is possible to separate the ice made in the tray 10 from the tray 10.

The motor 20 is connected to the connector 11*a* formed on one side of the tray 10. The connector 11*a* of the tray 10, which is connected to the motor 20, further includes a motor connector 11*a* with a given angle. That is, while the connectors 11*a* are being circular and connected to the frame assembly 30, the motor connector 11*a* is connected to the motor 20. Accordingly, the rotary force generated from the motor 20 is more stably transferred to the tray 10.

The frame assembly 30 determines the entire shape of the ice maker 100. That is, the tray 10 and the tray cap 40 excepting the motor 20 are located inside the frame assembly 30. Accordingly, only the frame assembly 30 is connected to the refrigerating room door 220 to stably fix the ice maker 100 to the refrigerating room door 220, and as the tray 10 rotates, in the state where the ice maker 100 is stably fixed to the refrigerating room door 220, the ice made in the tray 10 is separated from the tray 10 by free falling. That is, the ice maker 100 is simple in configuration and needs only the rotation of the tray 10, thereby ensuring high durability. Further, the frame assembly 30 whose front surface is open to allow the tray 10 located therein to be checked with the naked eye. As a result, the interior of the frame assembly 30 and the normal operation of the tray 10 or the tray cap 40 can be checked with the naked eye, thereby making it easy to perform the maintenance of the ice maker 100.

The frame assembly 30 includes a frame 31, supports 33, and a guide part 35. The frame 31 extends in a longitudinal direction of the frame assembly 30, and the supports 33 are disposed on both sides of the frame 31. The frame 31 includes an attachment plate 32. The attachment plate 32 comes into contact with the refrigerating room door 220 or a position at which the ice maker 100 is located. The attachment plate 32 has a plurality of attachment holes 32*a* formed thereon to connect the ice maker 100 to the refrigerating room door 220.

Further, a plurality of ribs 34 are located between the frame 31 and the attachment plate 32. For example, the frame 31 and the attachment plate 32 are connected vertically to each other, and the plurality of triangular ribs 34 are connected between the frame 31 and the attachment plate 32. The ribs 34 are located in a direction toward the tray 10. Through the ribs 34, accordingly, the frame 31 and the attachment plate 32 are more strongly coupled to each other, and further, the ice making parts 12 can be prevented from escaping from the refrigerating room door 220 or being damaged owing to external impacts.

The supports 33 are located on both sides of the tray 10 and fittedly coupled to the tray 10. The tray 10 has the connectors 11*a* protruding therefrom toward the supports 33. Through the coupling between the connectors 11*a* and the supports 33, accordingly, the rotating axis 19 of the tray 10 is formed, and the tray 10 rotates around the rotating axis 19.

The supports 33 are semi-circularly rounded toward the front side of the frame assembly that is, toward the body 210 of the refrigerator 200. Further, each support 33 has an extension portion 36 extending from the center thereof and increasing in width as it becomes close to the frame 31 of the frame assembly 30. Accordingly, the structural stiffness of the frame assembly 30 can be more improved.

The guide part 35 is located on top of the frame 31. The guide part 35 includes an inclined injection portion 35*a* formed therein. The injection portion 35*a* becomes narrow in area as it goes toward the tray 10 and is open toward the tray 10. Through the injection portion 35*a*, accordingly, the water supplied through the water supply hose 250 is induced to the tray 10, and as the water is supplied to the tray 10 in a state of being stored in the guide part 35, the water can be supplied to the tray 10 to a constant speed.

Figure 4:
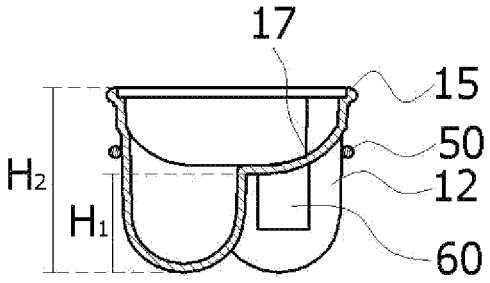
FIG. 4 is a sectional view taken along the line IV-IV of FIG. 2.
Figure 5:
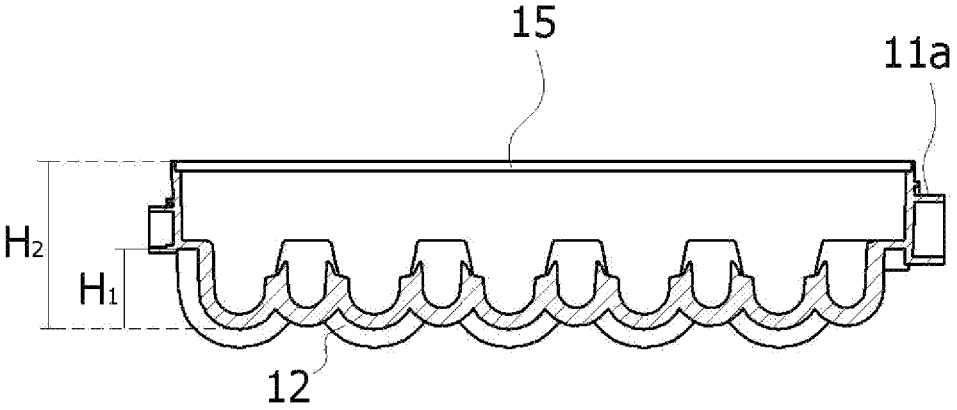
FIG. 5 is a sectional view taken along the line V-V of FIG. 2.

FIG. 4 is a sectional view taken along the line IV-IV of FIG. 2, and FIG. 5 is a sectional view taken along the line V-V of FIG. 2.

Referring to FIGS. 4 and 5, the tray 10 includes the tray body 11, the ice making parts 12, and tray walls 15. The connectors 11*a* protrude outward from both sides of the tray body 11. The ice making parts 12 are arranged in the tray body 11 in the zigzag manner (zigzag formation).

Further, the tray walls 15 are formed on the outer surfaces of the tray body 11. The tray walls 15 are higher than the ice making parts 12 to prevent the water filled in the tray 10 from overflowing when the refrigerating room door 220 moves or external impacts are applied to cause the water filled in the tray 10 to splash. More specifically, heights $H_2$ of the tray walls 15 are higher by 1.5 to 3 times than heights $H_1$ of the ice making parts 12. For example, if the refrigerating room door 220 is closed at a very fast speed to apply inertia to the water filled in the tray 10, the water moves along the tray walls 15 and falls down inside the tray 10 again by gravity, thereby being prevented from overflowing to the outside of the tray 10.

Further, the tray 10 includes curved surfaces 17 concavely formed from the tray walls 15 to the ice making parts 12. The curved surfaces 17 are formed in the range from the tray walls 15 to the ice making parts 12 in the direction of the inside of the tray 10. For example, the curved surfaces 17 are concavely formed. As mentioned above, when the water moves by inertia, it moves along the curved surfaces 17. In this case, the concave curved surfaces 17 increase the moving path of the water to thus decrease the moving speed of the water. Further, the curved surfaces 17 form one side surface of each ice making part 12, and if the pieces of ice are made in the ice making parts 12, accordingly, the entire stiffness of the tray 10 may be increased. For another example, the curved surfaces 17 may be convexly formed. Otherwise, the curved surfaces 17 may be concavely and convexly formed alternately. Accordingly, the moving path of the water can be more increased.

Temperature detecting sensors 60 are connected to the underside of the tray 10 or the side surface of the lower portion of the tray 10. For example, the temperature detecting sensors 60 are fitted to tray holders located at the lower portions of the ice making parts 12 of the tray 10 and thus connected to the tray 10. The temperature detecting sensors 60 serve to control the rotation of the tray 10 and the water supplied to the tray 10.

The temperature detecting sensors 60 generate signals for controlling the operation of the ice maker 100 and thus transmit the signal to a controller of the refrigerator 200. For example, the temperature detecting sensors 60 measure the temperatures at the insides of the ice making parts 12. If ice making is finished, the inner temperatures of the ice making parts 12 are below zero. Accordingly, it can be determined whether ice is made in the ice making parts 12. For another example, the temperature detecting sensors 60 measure temperature differences. That is, the temperature detecting sensors 60 measure a difference between a temperature when water is filled in the ice making parts 12 and a temperature when ice is made in the ice making parts 12. More specifically, as the mean temperature of the water supplied from the water supply hose 250 of the refrigerator is above zero, water is filled into the ice making parts 12 so that the inner temperatures of the ice making parts 12 become above zero. After that, if ice making is finished in the ice making parts 12, the inner temperatures of the ice making parts 12 become below zero. If the inner temperatures of the ice making parts 12 are 10 degrees below zero, a temperature difference in the ice making parts 12 is in the range between 10 and 30° C. Like this, the temperature detecting sensors 60 detect whether ice is made in the ice making parts 12 through the temperature difference.

If it is determined that the ice making is finished in the ice making parts 12, the temperature detecting sensors 60 transmit signals for separating the ice from the ice making parts 12. For example, if it is determined that the ice making is finished in the ice making parts 12, the temperature detecting sensors 60 transmit signals for transmitting electric current to the electrodes 50, so that heat is emitted from the tray 10. After that, if the ice is spaced apart from the inner surfaces of the ice making parts 12, the temperature detecting sensors 60 transmit signals for rotating the tray 10 to separate the ice from the tray 10. Further, if the insides of the ice making parts 12 are empty after the ice separation, the temperature detecting sensors 60 transmit signals for supplying water.

The temperature detecting sensors 60 are connected to the tray 10. For example, the temperature detecting sensors 60 are connected to the ice making parts 12 divided by section to detect the inside states of the ice making parts 12. More specifically, the ice making parts 12 have various shapes, and accordingly, the pieces of ice made in the ice making parts 12 are free in size. As a result, the ice making parts 12 are sorted by section, and the temperature detecting sensors 60 are disposed on the sections, respectively. Accordingly, the temperature detecting sensors 60 detect whether ice is made in the ice making parts 12 or not more accurately, thereby preventing water from pouring into the ice bucket 110 in a state where the water does not turn into ice.

The electrodes 50 are disposed on both sides of the tray body 11. For example, the electrodes 50 are located under the tray walls 15. Generally, the ice making parts 12 whose sectional areas become narrow as they are distant from the tray 10, and accordingly, the electrodes 50 are disposed at starting positions where the ice making parts 12 whose sectional areas are biggest to melt the surfaces of the pieces of ice formed on tops of the ice making parts 12, so that the pieces of ice naturally escape from the ice making parts 12. For another example, the electrodes 50 may be located on the moving parts 13 between the neighboring ice making parts 12. In the case where the water filled in the tray 10 turns into ice, the ice is formed even on the moving parts 13 to connect the pieces of ice made in the ice making parts 12 to one another. In this case, a lump of ice may be made irrespective of the shapes of the ice making parts 12, so that the lump of ice may apply an impact to the ice bucket 110 because of its size when separated from the tray 10 and freely falls. To avoid such a problem, accordingly, the electrodes 50 are located on the moving parts 13, and the pieces of ice produced according to the shapes of the ice making parts 12 are supplied to the ice bucket 110, thereby transferring the pieces of ice to the ice bucket 110 more easily and reducing the weight and impact applied to the ice bucket 110. For yet another example, the electrodes 50 are located on the undersides of the ice making parts 12. The higher the heights $H_1$ of the ice making parts 12 are, that is, the longer the depths of the ice making parts 12 are, the longer the pieces of ice become. In this case, the longer the depths of the ice making parts 12 are, the stronger the contact forces between the ice making parts 12 and the pieces of ice become. Accordingly, while the electrodes 50 are being not seen from the outside, they are located close to the ice making parts 12. That is, the electrodes 50 are located on the undersides of the ice making parts 12 to allow heat to be generated from the portions where the contact forces between the inner surfaces of the ice making parts 12 and the pieces of ice are strong, thereby enabling the pieces of ice from escaping from the ice making parts 12 more easily.

Figure 6:
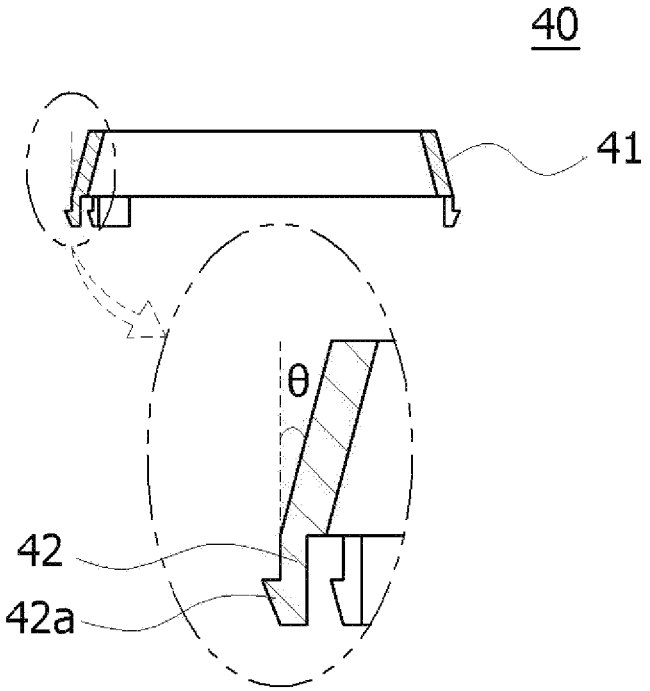
FIG. 6 is a sectional view taken along the line VI-VI of FIG. 2.

FIG. 6 is a sectional view taken along the line VI-VI of FIG. 2.

Referring to FIG. 6, the guard part 41 of the tray cap 40 is inclinedly formed in the direction toward the inside of the tray 10. In this case, the guard part 41 has an inclination θ in the range between 5 and 90°. For example, the water moving along the curved surfaces 17 of the tray 10 moves to the tray walls 15 as the moving speed thereof is decreased. In this case, the water moves along the guard part 41 inclined in the direction toward the inside of the tray 10 and then moves between the tray 10 and the tray cap 40 as if it swirls. Through the formation of the guard part 41, accordingly, even water to which a substantially high inertial force is applied can be prevented from overflowing to the outside of the ice maker 100.

The guard part 41 may be changed in shape by the transfer of the ice. For example, the guard part 41 is made of silicone. In addition to prevent water from overflowing, accordingly, the guard part 41, which is made of a soft material, does not interfere with the hard ice transferred.

The tray connectors 42 are formed in a direction from the guard part 41 to the tray 10 and have protrusions 42*a* protruding from one side thereof to be lockedly fitted to the tray 10. Accordingly, the tray 10 and the tray cap 40 can be more tightly coupled to each other.

Figure 7:
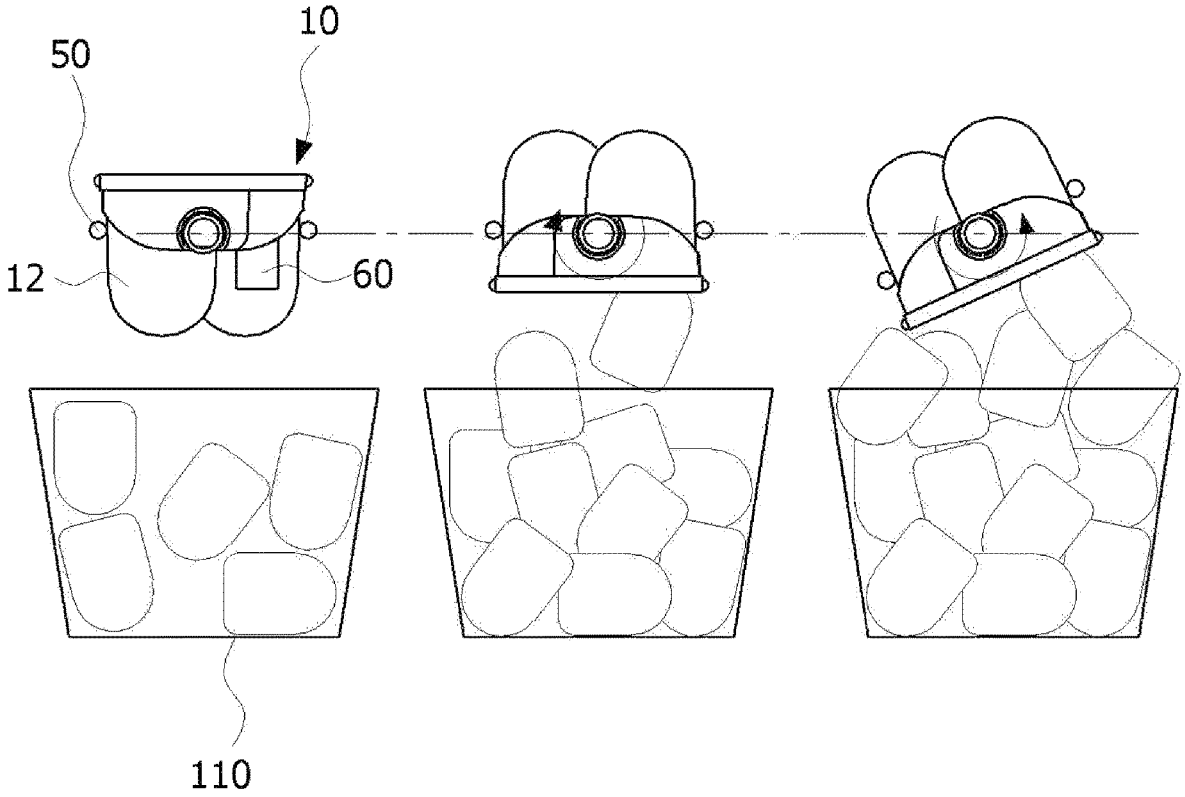
FIG. 7 is a perspective view showing an ice separation operation of the ice maker of FIG. 2.

FIG. 7 is a perspective view showing an ice separation operation of the ice maker of FIG. 2.

Referring to FIG. 7, the tray 10 of the ice maker 100 rotates around the rotating axis 19 formed by the connectors 11*a*. In this case, the ice freely falls into the ice bucket 110. Through the free falling, accordingly, there is no need for providing an additional space for an ice moving duct for moving the ice down. As a result, the ice making parts 12 of the tray 10 can be increased in size by the space made by separating the additional space, thereby allowing the tray 10 having a larger amount of ice than the trays in other ice makers that separate ice using an ejector, without any rotation.

For example, while the tray 10 rotates to move the ice to the ice bucket 110 by free falling, if the ice is full in the ice bucket 110, the tray 10 does not rotate by the ice and detects a full ice state. According to a case wherein the tray 10, to which a rotary force is transferred, does not rotate by a desired degree to apply a load to the motor 20 and a case wherein the tray 10 does not rotate to a desired degree or does not return to its original position after rotating to the desired degree, a degree of full ice is measured. More specifically, if the tray 10 does not twist by a desired angle upon ice separation, the tray 10 returns to its original position and stops ice making. Further, if the tray 10 is locked onto the ice and does not return to its original position after the ice separation through its rotation, the tray 10 recognizes the full ice state and stops ice making. After that, if the ice is used, the height of ice accumulated in the ice bucket 110 is reduced, and accordingly, the tray 10 tries to return to its original position by periodic operation of the motor 20.

More specifically, if it is defined that the rotation of 180° of the tray 10 is a forward rotation with respect to the normal state (0°) of the tray 10, a rotation in a direction from a position of 180° to a position of 0° is a reverse rotation. Further, the time required from the position of 0° to the position of 180° or from the position of 180° to the position of 0° is called set time.

For example, in the case where it is determined that the ice making in the ice making parts 12 is finished through the temperature detection sensors 60, if electricity is applied to the motor the tray 10 performs the forward rotation of 180°, and if the tray 10 reaches the position of 180° within the set time, the electric current is increased. In this case, the tray 10 stops, and the electricity is applied to the ice maker 100 during given time to heat the tray 10, so that the ice making parts 12 are heated to melt the pieces of ice made therein to allow the pieces of ice to freely fall down. If the temperature of the tray 10 is increased, the supply of electric current to the tray 10 is stopped to thus rotate the tray 10 reversely through the motor 20. In this case, if a load is increased before the set time needed for the rotation, it is determined that the tray 10 is locked onto the ice because of full ice, and next, the supply of water to the ice maker 100 is stopped to allow the tray 10 to rotate forwardly again to the position of 180°. The reverse rotation is periodically tried, and if the tray 10 reaches the position of 0° within the set time to thus increase the load, the full ice state is released, so that water is supplied again to the ice maker 100 to perform ice making.

For another example, in the case where it is determined that the ice making in the ice making parts 12 is finished through the temperature detection sensors 60, if electricity is applied to the motor 20, the tray 10 rotates forwardly to increase a load current within the time shorter than the set time, full ice is determined.

In this case, the tray 10 rotates reversely and reaches the position of 0°. If the tray 10 periodically rotates forwardly to increase the load within the set time, the tray 10 reaches the position of 180°, and in this case, electricity is applied to the tray 10 to heat the tray 10, so that ice separation is performed. After the ice separation, if the tray 10 twists reversely to increase the load within the set time, water is continuously supplied to perform ice making. If the load is increased before the set time during the reverse rotation at the position of 180°, full ice is determined, and in this case, the tray 10 rotates forwardly again to reach the position of 180° and stops. The tray 10 periodically tries to rotate reversely, and if the tray 10 reaches the position of 0° within the set time to increase the load, the full ice state is released, so that water is supplied again to the ice maker 100 to perform ice making.

That is, the ice maker 100 detects ice separation and full ice through the principle of the rotation of the motor 20, not through a mechanism or optical sensor for detecting full ice.

Further, the ice maker 100 detects the full ice more reliably through the entire tray 10 mechanically rotating, than that through a shut-off arm, ball wire, or an optical sensor that just detect the full ice on portions thereof. That is, if the full ice is detected through the rotation of the tray 10 itself, the entire three-dimensional space of the ice maker 100 is sensed, thereby removing detection errors, and without any additional sensor, further, a control logic can be made only with the load of the motor. In the existing full ice detection method wherein a gear structure is additionally provided to an ice separation motor to perform line detection for a portion to which ice falls in a longitudinal direction by a full ice detection sensor or optical sensor that moves or rotates vertically with respect to a direction along which ice moves down, however, the entire top of the ice bucket 110 cannot be sensed, so that the ice is accumulated on the space not sensed and thus overloaded on the ice bucket 110.

Figure 8:
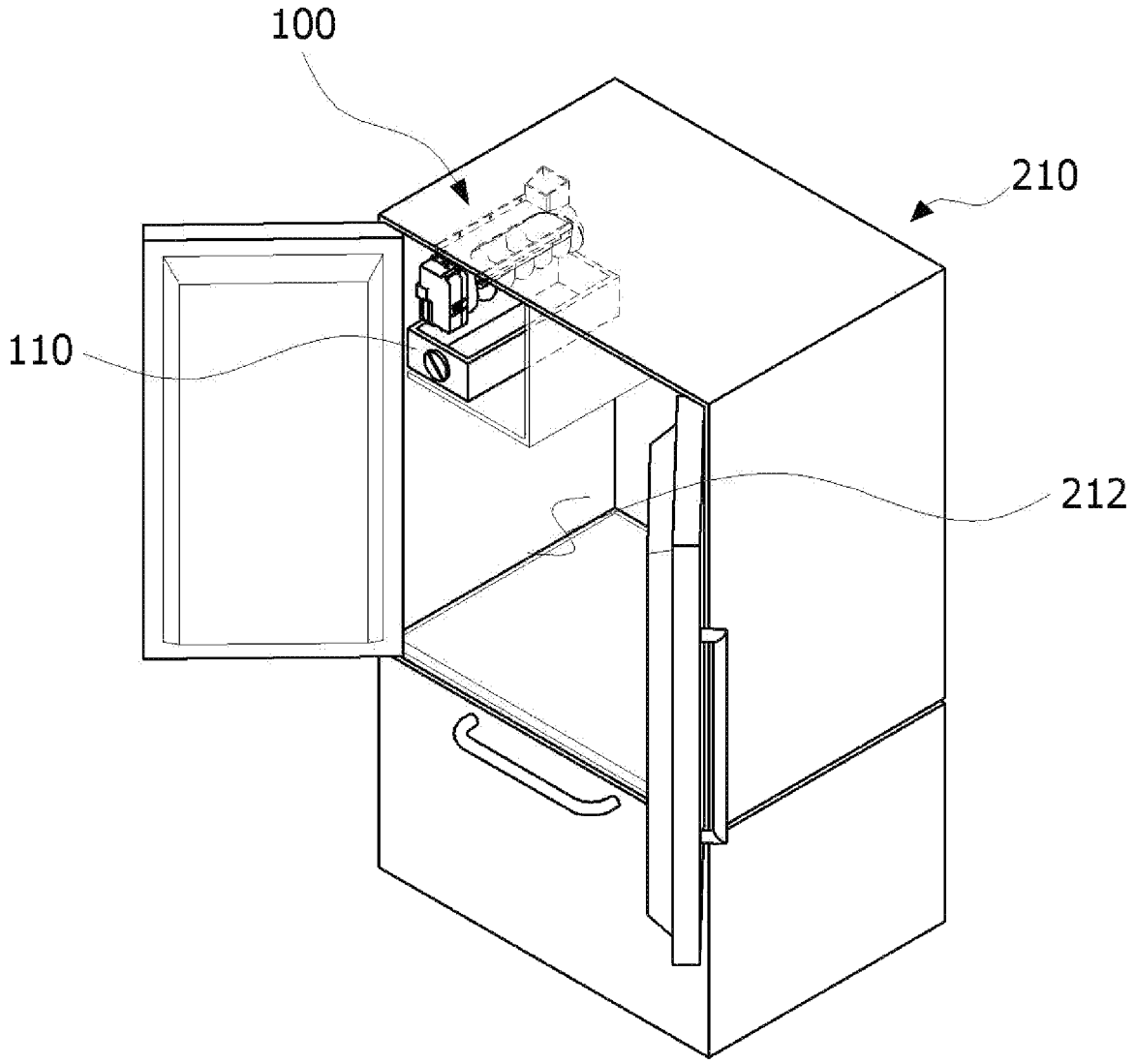
FIG. 8 is a perspective view showing a refrigerator having the ice maker of an embodiment of the present invention disposed in a freezing room.
Figure 9:
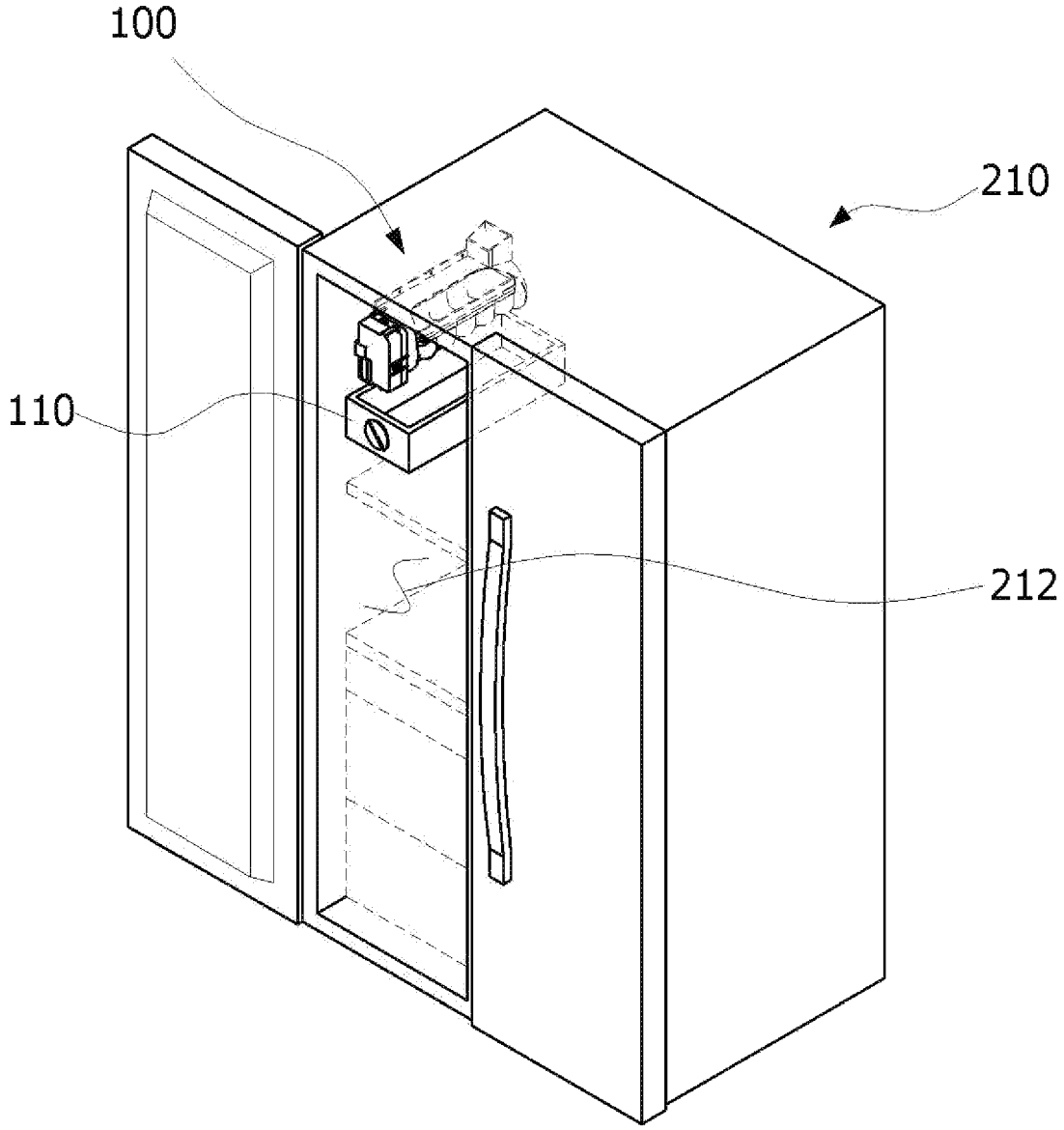
FIG. 9 is a perspective view showing a refrigerator having the ice maker of an embodiment of the present invention disposed in a refrigerating room.

FIG. 8 is a perspective view showing a refrigerator having the ice maker of an embodiment of the present invention disposed in a freezing room, and FIG. 9 is a perspective view showing a refrigerator having the ice maker of an embodiment of the present invention disposed in a refrigerating room.

Referring to FIGS. 8 and 9, the ice maker 100 may be mounted on various types of refrigerators 200. The ice maker 100 may be mounted on the freezing room 214 of a side-by-side type of refrigerator 200. In this case, the ice maker 100 turns the water filled in the tray 10 into ice by using the cold air generated from the freezing room 214.

Further, the ice maker 100 may be mounted on top of the refrigerating room 212 of a three-door type refrigerator 200. In this case, a space in which the ice maker 100 is disposed is partitioned inside the refrigerating room 212. Through the formation of the space, accordingly, the cold air supplied to the ice maker 100 is not transferred to the refrigerating room 212, thereby preventing ice making capability from being lowered.

According to one or more embodiments of the present invention, the ice maker 100 can be mounted in narrow spaces inside various types of refrigerators 20 and make ice with various shapes. Further, the ice maker 100 can reduce electricity consumption upon the ice separation and provide a relatively large amount of ice because of high-speed ice making.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An ice maker disposed in a refrigerator to provide ice to an ice bucket, the ice maker comprising:

a tray configured to be filled with water and positioned in the ice maker to freeze the water to make ice, the tray including a thermal conductive composite material configured to emit heat in response to an electric current supplied thereto and a plurality of ice making holders;

a frame assembly connected to the tray;

electrodes connected to two sides of the tray;

a motor connected to the tray and configured to rotate the tray so that the ice is separated from the tray by gravity; and a temperature detecting sensor fitted to a tray holder located at a lower portion of the plurality of ice making holders, wherein the frame assembly comprises:

supports with fitting grooves positioned thereon to connect the tray;

a frame extending in a longitudinal direction of the tray to connect the supports;

an attachment plate connected to the frame and including a plurality of attachment holes positioned thereon;

a guide connected to a top of the frame and including an inclined injection portion to direct water to the tray; and a plurality of triangular ribs located between the frame and the attachment plate, wherein the ribs are oriented toward the tray, thereby coupling the frame and the attachment plate to each other, wherein the electrodes are positioned on the left and right sides of the plurality of ice making holders, adjacent to a portion where ice is made, and the electrodes are covered by flexible electrical wires, wherein the temperature detecting sensor is configured to:

control rotation of the tray and water supply to the tray by measuring the temperature inside the plurality of ice making holders;

transmit a signal to supply electric current to the electrodes and heat the tray upon determining that ice is made in the plurality of ice making holders;

transmit a signal to rotate the tray and separate the ice from the tray when the ice is spaced apart from an inner surface of each of the plurality of ice making holders; and transmit a signal to supply water to the tray when each of the plurality of ice making holders is empty.

2. The ice maker according to claim 1, wherein the plurality of ice making holders are arranged in a zigzag formation, and wherein the tray comprises:

moving parts each connecting neighboring ice making holders of the plurality of ice making holders to each other to move the water along a path; and a tray wall extending outward from the plurality of ice making holders to prevent the water filled in the tray from overflowing.

3. The ice maker according to claim 2, wherein each moving part is positioned to form a diagonal line between the neighboring zigzag ice making holders.

4. The ice maker according to claim 2, wherein the tray comprises curved surfaces concavely formed from the tray walls to the plurality of ice making holders.

5. The ice maker according to claim 2, wherein one of the plurality of ice making holders has a height, and wherein the tray wall has a height which is 1.5 to 3 times higher than the height of the one of the plurality of ice making holders.

6. The ice maker according to claim 2, wherein the plurality of ice making holders have different sectional shapes from one another.

7. The ice maker according to claim 1, wherein the electrodes are positioned on portions where the ice is separated from the plurality of ice making holders on the outside of the tray.

8. The ice maker according to claim 1, wherein the thermal conductive composite material includes any one polymer selected from a group consisting of a carbon fiber, a carbon nanotube, a graphene, and a metal-containing polymer.

9. The ice maker according to claim 1, wherein the motor rotates the tray to an angle in a range of 100 and 180°.

10. The ice maker according to claim 9, wherein the motor detects full ice in the ice bucket according to the angle of the tray.

11. The ice maker according to claim 1, further comprising a tray cap connected to a top of the tray to reduce an area of the top of the tray so that the water filled in the tray is prevented from overflowing because of inertia generated by a movement of the tray.

12. The ice maker according to claim 11, wherein the tray cap comprises:

a guard slantly formed and configured to be deformed in shape by a transfer of the ice; and tray connectors protruding from the guard and connected to the tray.

* * * * *